US007011302B2

(12) United States Patent
Bates et al.

(10) Patent No.: US 7,011,302 B2
(45) Date of Patent: Mar. 14, 2006

(54) VERTICAL POCKET FEEDER

(75) Inventors: Jerry L. Bates, Redlands, CA (US); Earl J. Anker, Tinley Park, IL (US)

(73) Assignee: Systems Technology, Inc., San Bernardino, CA (US)

( * ) Notice: Subject to any disclaimer, the term of this patent is extended or adjusted under 35 U.S.C. 154(b) by 315 days.

(21) Appl. No.: 10/443,124

(22) Filed: May 21, 2003

(65) Prior Publication Data

US 2004/0245716 A1 Dec. 9, 2004

(51) Int. Cl.
*B65H 83/00* (2006.01)

(52) U.S. Cl. ..... 271/3.05; 271/3.07; 271/3.12; 271/197; 271/198; 271/201; 271/188

(58) Field of Classification Search ..... 271/3.01, 271/3.02, 3.03, 3.05, 3.06, 3.07, 3.12, 10.01, 271/11–13, 10.06, 10.17, 10.09, 10.1, 94, 271/97, 99, 104, 194, 196, 197, 198, 188, 271/201

See application file for complete search history.

(56) References Cited

U.S. PATENT DOCUMENTS 3,591,171 A * 7/1971 Schmidt ..... 271/185
3,690,650 A * 9/1972 Maier et al. ..... 271/211
3,881,718 A * 5/1975 Fernandez-Rana et al. ..... 271/10.09
3,904,191 A * 9/1975 Maier et al. ..... 271/150
3,946,633 A 3/1976 Campbell ..... 271/3.1
4,008,890 A * 2/1977 Pulda ..... 271/151
4,164,348 A * 8/1979 Doria ..... 271/221
4,177,982 A * 12/1979 Bewersdorf et al. ..... 271/5
4,180,259 A * 12/1979 Bewersdorf et al. ..... 271/200
4,183,517 A * 1/1980 Hageman et al. ..... 271/150
4,366,955 A * 1/1983 Pessina et al. ..... 271/7
4,436,297 A 3/1984 Chandhoke ..... 271/3.1
4,618,136 A * 10/1986 Pessina et al. ..... 271/150
4,657,237 A * 4/1987 Hansch ..... 271/178
4,747,592 A * 5/1988 Pessina et al. ..... 271/13
4,771,896 A 9/1988 Newsome ..... 271/3.1
4,772,003 A * 9/1988 Nobuta et al. ..... 270/52.14
4,783,065 A * 11/1988 Graves, Sr. ..... 271/151
4,907,791 A 3/1990 Higgins et al. ..... 271/5
4,911,421 A * 3/1990 Hannon ..... 271/161
4,973,038 A * 11/1990 Curley et al. ..... 271/146
5,042,792 A * 8/1991 Honegger et al. ..... 271/188
5,197,590 A * 3/1993 Prim et al. ..... 198/300
5,282,613 A * 2/1994 Standerfer et al. ..... 271/202
5,326,088 A * 7/1994 Newsome ..... 271/3.23
5,374,050 A 12/1994 Prim ..... 271/221
6,017,028 A 1/2000 St. John et al. ..... 271/3.01
6,017,029 A 1/2000 Bates et al. ..... 271/3.12
6,220,590 B1 * 4/2001 Bates et al. ..... 271/3.01
6,247,694 B1 * 6/2001 Nonnemacher et al. ..... 271/146
6,315,286 B1 * 11/2001 Muenchinger et al. ..... 271/146
6,427,999 B1 * 8/2002 Christofferson ..... 271/201
6,467,768 B1 * 10/2002 Vary et al. ..... 271/150
6,572,101 B1 * 6/2003 Kaya et al. ..... 271/210
6,637,740 B1 * 10/2003 Pessina et al. ..... 271/3.03

* cited by examiner

*Primary Examiner*—Donald P. Walsh
*Assistant Examiner*—Matthew J. Kohner
(74) *Attorney, Agent, or Firm*—Roberts & Roberts, LLP

(57) ABSTRACT

Vertical pocket feeder signature handling equipment which supplies signatures in an on-edge orientation one at a time to bindery equipment. The vertical pocket feeder particularly cooperates with a hopper loader apparatus which transfers and separates individual signatures of sheet materials from a vertically aligned, stack of such signatures. The separated, individual signatures may then be subjected to bindery operations such as stapling or stitching.

29 Claims, 8 Drawing Sheets

VERTICAL POCKET FEEDER

BACKGROUND OF THE INVENTION

1. Field of the Invention

The present invention relates to signature handling equipment which supplies signatures in an on-edge orientation one at a time to bindery equipment. The invention particularly cooperates with a hopper loader apparatus which transfers and separates individual signatures of sheet materials from a vertically aligned, stack of such signatures. The separated, individual signatures may then be subjected to bindery operations such as stapling or stitching.

2. Description of the Related Art

It is usual in the graphic arts that sheet materials such as newspapers, books, printed cartons and the like emerge from a printing operation in a serial stream of partially overlapping signatures in shingled form. Such a stream of signatures is collected on a conveyor and moved to a stacker for aligning. The stacker receives the sheets in a serial mode from the conveyor and forms an aligned stack for removal and transportation. While large numbers of signatures can be conveniently handled in stack form, some operations on the signatures can only be performed individually. These include such bindery operations as stitching and stapling, among others. It therefore becomes necessary to separate individual signatures from a stack for individual treatment. A signature feed assembly is commonly used to feed signatures one at a time from a hopper onto a conveyor. One known assembly for feeding signatures one at a time onto a conveyor is disclosed in U.S. Pat. No. 4,180,255. Known signature supply assemblies have previously been used to supply signatures to a hopper in a signature feed assembly. Known signature supply assemblies or hopper loaders are disclosed in U.S. Pat. Nos. 3,674,258 and 3,945,633. The signature supply assemblies disclosed in the aforementioned patents supply signatures to a hopper in a generally horizontal orientation. Although hopper loaders are known in the art to supply a stream of generally horizontally positioned signatures, upstanding on-edge vertical signatures are generally required for feeding the signatures one at a time for processing by many stitcher lines.

Signature supply assemblies for supplying signatures in a vertical, an on-edge orientation are disclosed in U.S. Pat. Nos. 4,177,982 and 4,436,297. The complicated nature of the construction and mode of operation of known on-edge signature supply assemblies increases the probability of a jam or other malfunction during operation of the signature supply assemblies. In addition, the more complicated the construction of the signature supply assembly, the greater will be the cost of construction. The present invention seeks to simplify hopper loader construction cost.

It has been a problem in the art to reliably provide an efficient and effective means of separating a stack into its individual signatures for presentation to such bindery equipment. Prior art hopper loaders do not run reliably with a large range of signature sizes. The paper stock may range from heavyweight to lightweight and from a few pages per signature to many pages per signature. This difference in paper weight and/or pagination has required the operator to perform many adjustments to make the machine ready for a production run.

In addition, prior art hopper loaders for bindery equipment must be relatively fixed in position. That is, due to its complexity and the need to critically place the hopper loader in correct position adjacent to the bindery equipment, the hopper loader has not been mobile. That is, one cannot easily move the prior hopper loaders from one piece of bindery equipment to another. The present invention seeks to enhance hopper loader mobility. In the past, a stacked pile of printed signatures has been moved on a horizontal conveyor to an upwardly moving conveyor where both conveyors travel at the same speed. Such an operation has many disadvantages since the stack does not reliably separate into evenly spaced overlapping individual signatures. This unevenness inevitably leads to down stream signature jams and misfeeds requiring considerable operator attention. U.S. Pat. No. 4,180,259 discloses a system for varying the drop of sheets into a hopper. Signatures are fed in a shingled stream and dropped one-by-one into a hopper, which then feeds a gathering chain. Signatures are stripped from a stack and are passed around a complex series of rollers and a large drum ultimately to a pocket. U.S. Pat. No. 5,374,050 discloses a conveyor wherein a stream of signatures is moved upwardly to a pocket having a jogger for the stacked stream of signatures. Difficulties in operating vertical loaders such as disclosed in these prior patents arise in that a large quantity of signatures cannot be loaded in the loader without interfering with the feeding of signature at the supply station, and the loaders cannot handle very short and very long signatures without substantial changes in the feeding mechanism. Further, the signatures are subjected to a constant riffling, sliding and jostling action that results in damage to the folds on the signatures when they move between conveyor belts. U.S. Pat. No. 4,973,038 also discloses a signature handling apparatus, however, this disclosure uses a horizontal feed conveyor which requires a stack pusher. The signatures tend to slide down a second ramp conveyor and hence require a retainer wedge. The present invention operates in the absence of such a pusher.

The present invention provides a vertical loader which avoids or reduces problems encountered in the prior art. The present invention pertains to an apparatus for separating individual signatures which are substantially vertically aligned on a folded edge from a stack of signatures and then feeding them into a pocket from which they are fed by a feed mechanism to bindery equipment. Individual signatures flow reliably, one-by-one out of the pocket to bindery equipment. The simplified equipment is economical, mobile, and signature size changeovers are easy to accomplish.

These and other features, advantages and improvements will be in part discussed and in part apparent to one skilled in the art upon a consideration of the detailed description of the preferred embodiment and the accompanying drawings.

SUMMARY OF THE INVENTION

The invention provides an apparatus for forming a generally vertically oriented stack of on-edge signatures from a horizontally oriented stack of signatures which comprises:

- an accumulating hopper for collecting a horizontally oriented stack of signatures;
- a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, which guide exerts a pressure normal to a top surface of the conveyor belt; the conveyor belt and the guide being positioned to retain a shingled stream of signatures therebetween and being adapted for depositing an edge of each signature of the stream of signatures onto a top surface of a receiving surface.

The invention also provides a method for forming a generally vertically oriented stack of on-edge signatures from a horizontally oriented stack of signatures which comprises:

I. providing an apparatus for forming a generally vertically oriented stack of on-edge signatures from a horizontally oriented stack of signatures which comprises:

an accumulating hopper for collecting a horizontally oriented stack of signatures;

a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, which guide exerts a pressure normal to a top surface of the conveyor belt; the conveyor belt and the guide being positioned to retain a shingled stream of signatures therebetween and being adapted for depositing an edge of each signature of the stream of signatures onto a top surface of a receiving surface;

II. collecting a horizontally oriented stack of signatures in the accumulating hopper;

III. forming a shingled stream of said signatures against the conveyor belt by pulling a stream of lowermost signatures from the horizontally oriented stack of signatures in the accumulating hopper by the vacuum conveyor;

IV. leading the shingled stream of signatures away from the accumulating hopper and from the horizontally oriented vacuum source to the downwardly extending portion of the conveyor belt toward the top surface of a receiving surface while pressing the shingled stream of signatures between the guide and the conveyor belt, and depositing an edge of each signature of the stream of signatures onto a top surface of the receiving surface.

The invention further provides a machine for forming a generally vertically oriented stack of on-edge signatures which comprises:

I. an apparatus for forming a generally vertically oriented stack of on-edge signatures from a horizontally oriented stack of signatures which comprises:

an accumulating hopper for collecting a horizontally oriented stack of signatures;

a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, which guide exerts a pressure normal to a top surface of the conveyor belt; the conveyor belt and the guide being positioned to retain a shingled stream of signatures therebetween and being adapted for depositing an edge of each signature of the stream of signatures onto a top surface of a receiving surface; and II. a hopper-loader which deposits a stream of signatures into the accumulating hopper.

In one embodiment the above described hopper loader comprises a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

DETAILED DESCRIPTION OF THE PREFERRED EMBODIMENT

Figure 1:
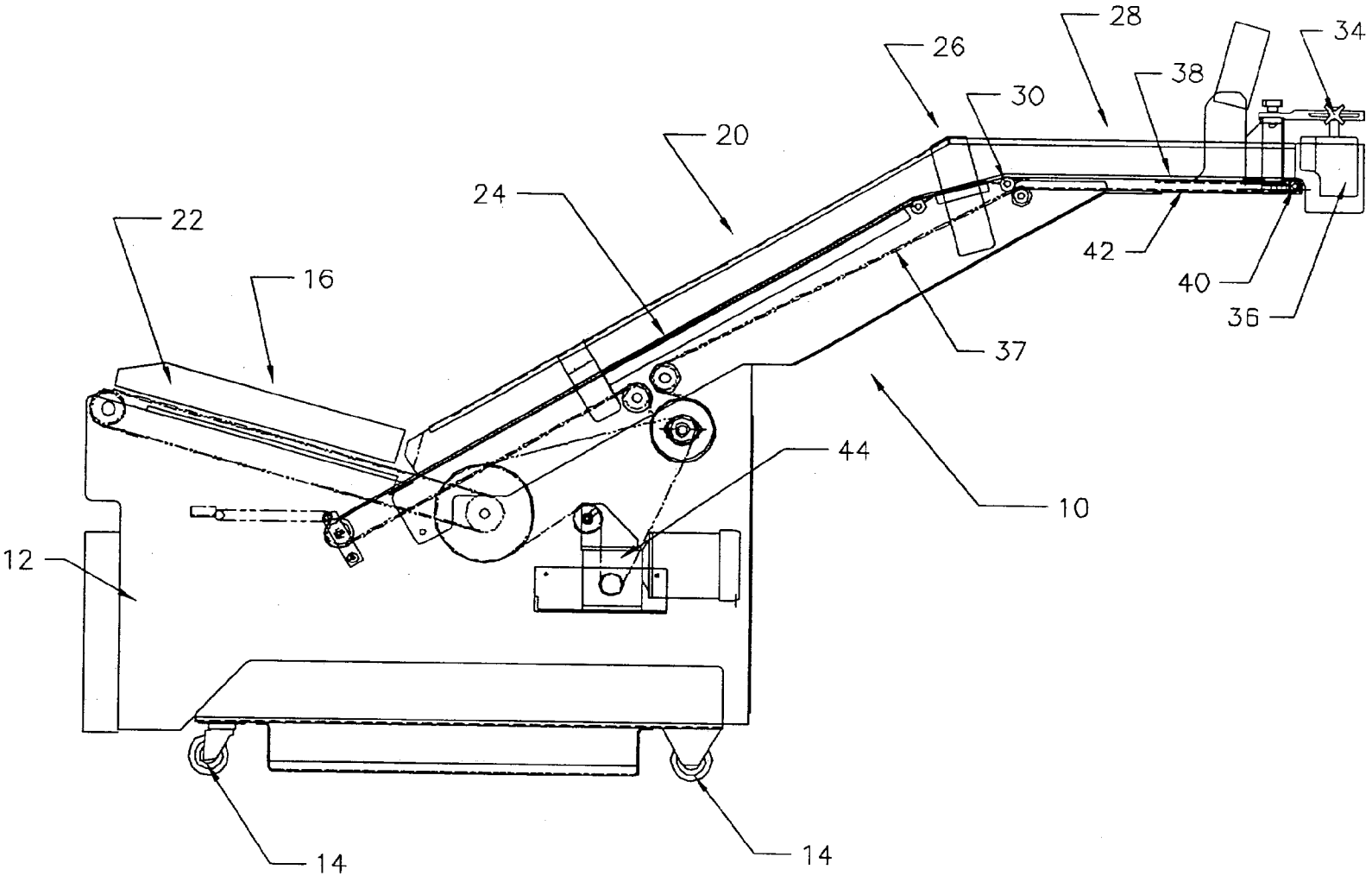
FIG. 1 shows a side view of the hopper loader according to the invention.
Figure 2:
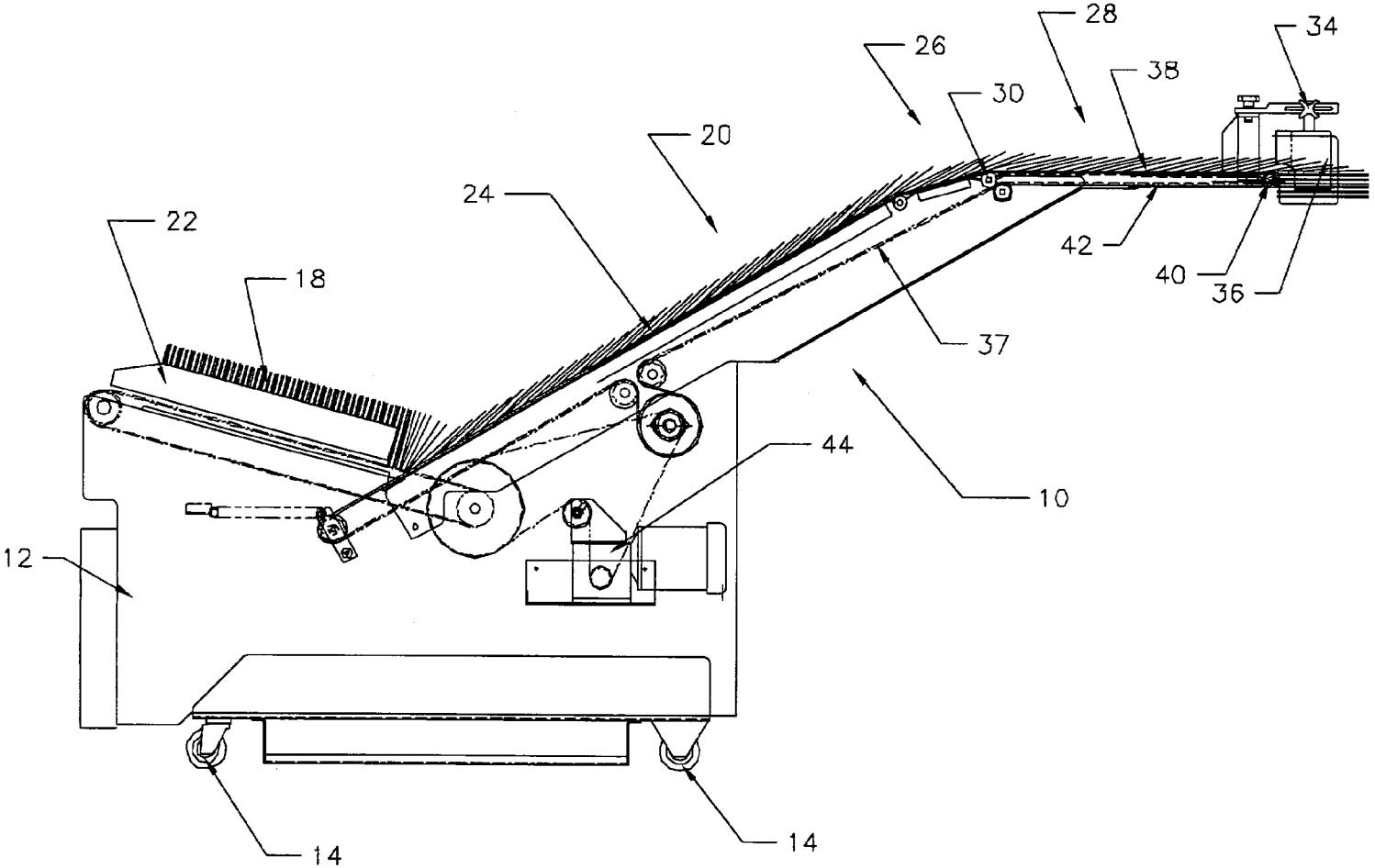
FIG. 2 shows a side view of a hopper loader according to the invention and further showing the movement path of signatures.

Referring to the drawings, FIGS. 1 and 2 show a hopper loader 10 according to the invention. It comprises a framework 12 which is movable by wheels 14. It has a first, downwardly inclined, planar conveyor 16 which preferably comprises a plurality of conveyor belts. In the preferred embodiment the belts are sturdy enough to move a relatively heavy stack of sheet signatures 18. As shown, the signatures are substantially vertically aligned and are in the form of a parallelepiped shaped stack. It is an important feature of the invention that the conveyor 16 be downwardly inclined. In the preferred embodiment, conveyor 16 has a downward decline measured from the horizontal of from about 100 to about 20°. This downward decline provides a gravity assist in the feeding of individual signatures from conveyor 16 to second upwardly inclined, planar conveyor section 20. In the preferred embodiment, the belts of the first conveyor are flat top chain belts and the second conveyor comprises a plurality of driven belts such that the belts of the first conveyor are aligned and interdigitated with the belts of the second conveyor.

The second conveyor 20 is capable of separating individual signatures from the stack on the first conveyor at an entry end of the second conveyor. Signatures fall over into an evenly overlapping shingled stream and travel up the second ramp conveyor as shown. In the preferred embodiment, the second conveyor has an upward incline measured from the horizontal of from about 25° to about 35°. An important feature of the invention is that an angle is formed between the first, downwardly inclined, planar conveyor and the second, upwardly inclined, planar conveyor which is from about 125° to about 145°. In addition, it is also important that the belts of the second conveyor belts travel at a speed which is faster than the belt speed of the first conveyor. In the preferred embodiment, the belt speed of the first conveyor ranges from about 1.1 feet/minute to about 7.1 feet per minute.

In the preferred embodiment, the belt speed of the second conveyor ranges from about 5.9 feet/minute to about 38.5 feet per minute. Most preferably the speed ratio of the second conveyor to the first conveyor is from about 3:1 to about 9:1. This combination of downward sloping first conveyor, upward sloping second conveyor, included angle of from about 125° to about 145° and speed differential gives a smooth, even transition from a stack of signatures to a thick shingled stream of even overlapping individual signatures.

The hopper loader configuration according to the invention, allows processing of a wide variety of sizes of signatures from thick multipage books to thin signatures having a very few pages. In the preferred embodiment, the signatures are supported down the first conveyor by a side guide 22.

As shown in FIG. 2, the stream of individual signatures travels up the incline of second conveyor in overlapping shingles fashion. The second conveyor comprises several integral, sequential segments, namely an upwardly inclined planar ramp segment 24, an arched transition segment 26, and a planar exit segment 28. The belts of the second conveyor move up ramp segment 24 and around the arched transition segment 26. The arched transition segment 26 comprises either a curved sheet metal slide over which the belts slide or a plurality of serially arranged rollers, such as 30. Preferably the arched transition segment comprises from about two to about five rollers. The arched transition segment has a radius of curvature sufficiently large such that a signature moved by the second conveyor has a greater tendency to follow a path of the arched transition segment than to be propelled tangent to the upwardly inclined planar ramp segment. Preferably the arched transition segment has an effective radius of curvature of at least about 10 inches and more preferably from about 10 inches to about 15 inches.

Figure 3:
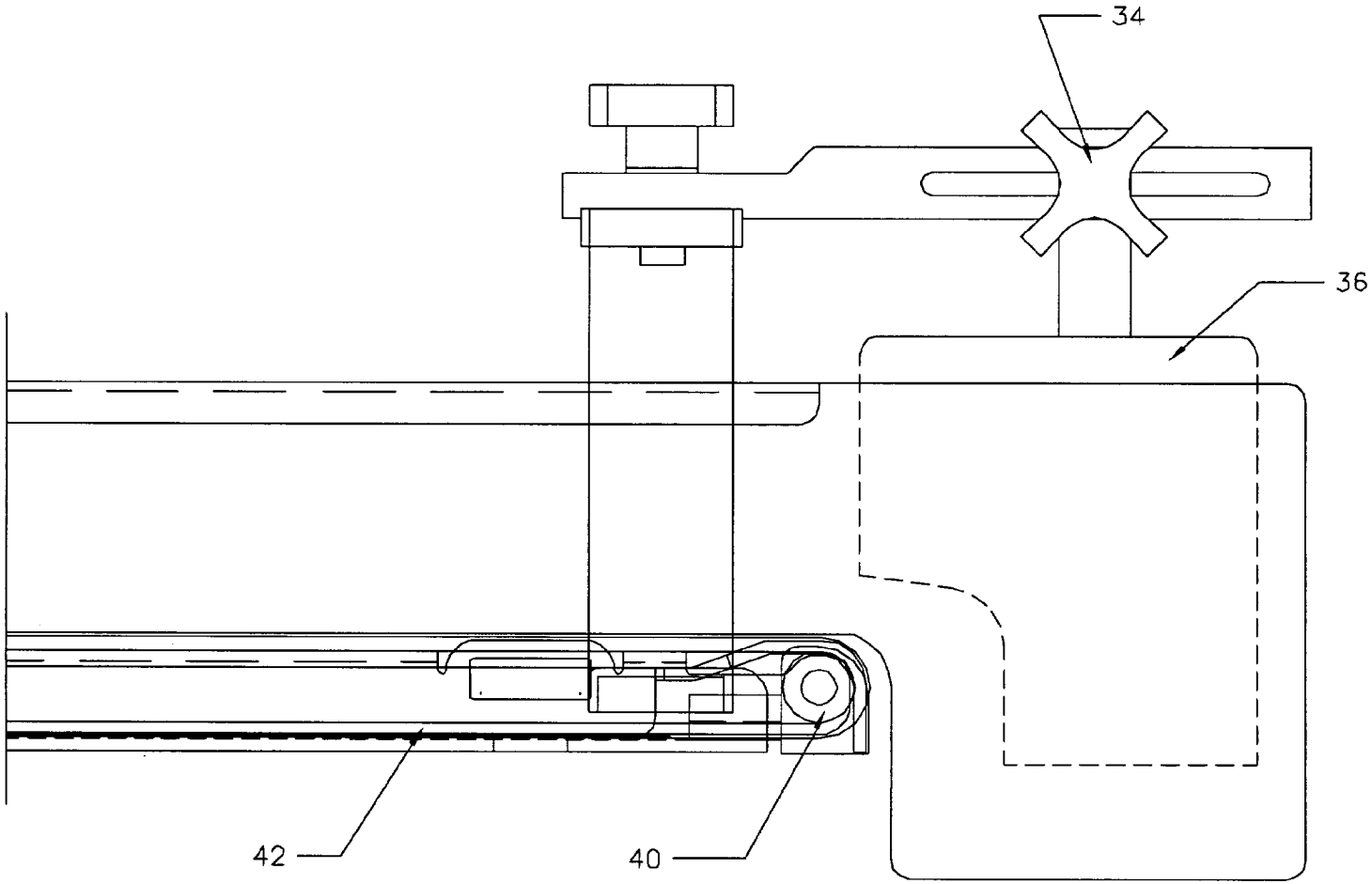
FIG. 3 shows a side view of the right side of the planar exit segment of the second conveyor showing signature pushers and a signature jogger.
Figure 4:
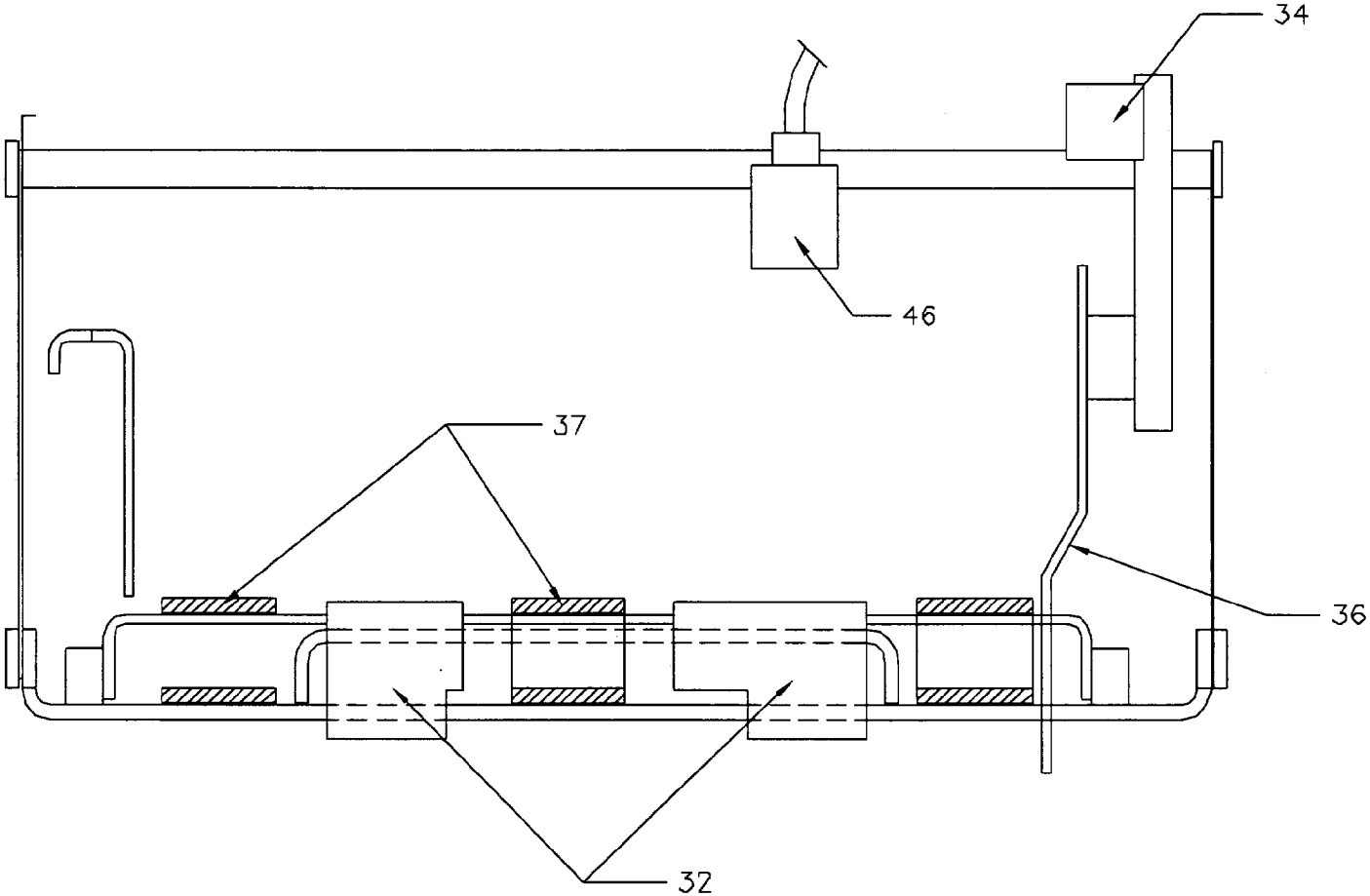
FIG. 4 shows a view of the front of the planar exit segment of the second conveyor showing signature pushers and a signature jogger.

The arched transition segment 26 progresses to planar exit segment 28. Preferably the planar exit segment of the second conveyor has a downward decline of from about 5° to about 20° measured from the horizontal. As shown in FIGS. 3 and 4 the planar exit segment of the second conveyor showing preferably has a plurality of reciprocating signature pushers such as L-shaped signature pushers 32 positioned between the belts 37, which push the signatures in a forward direction. Optionally, but preferably the planar exit segment of the second conveyor has a signature jogger 34, which aligns the signatures via jogger paddles 36 for exit from the second conveyor. The exit segment 28 preferably has a horizontal or declining upper segment 38 terminating at a belt turnaround roller 40, which meets a substantially horizontal belt return segment 42. Preferably the turnaround roller has a diameter of about 3 inches or less. Preferably the angle between the upper segment and the return segment is in the range of about 10° or less. This gives a needle-nosed configuration which greatly assists in the precision placement of exiting signatures to subsequent processing equipment.

The movement of the first and second conveyors is accomplished by suitable drive means including motors, pulleys, belts and rollers shown generally at 44. It is understood that the provision of such suitable drive means is well within the ability of those skilled in the art.

In the preferred embodiment, the drive of the first conveyor and the second conveyor are controlled by a sensor 46 such as a photoelectric cell which is responsive to the presence or absence of a signature at a position.

Figure 5:
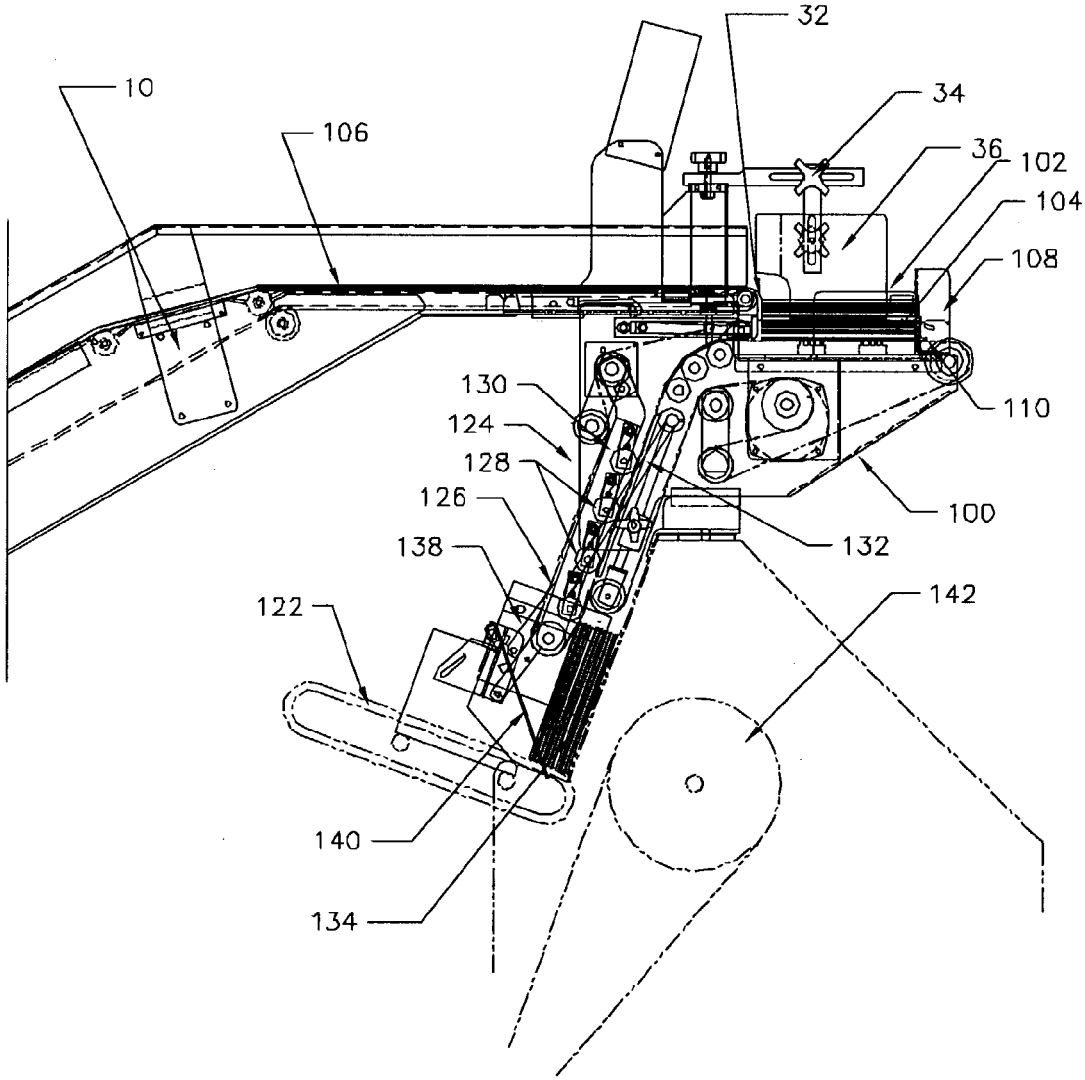
FIG. 5 shows an apparatus for forming a generally vertically oriented stack of on-edge signatures from a horizontally oriented stack of signatures according to the invention. The apparatus is attached to an exit end of a hopper loader.
Figure 6:
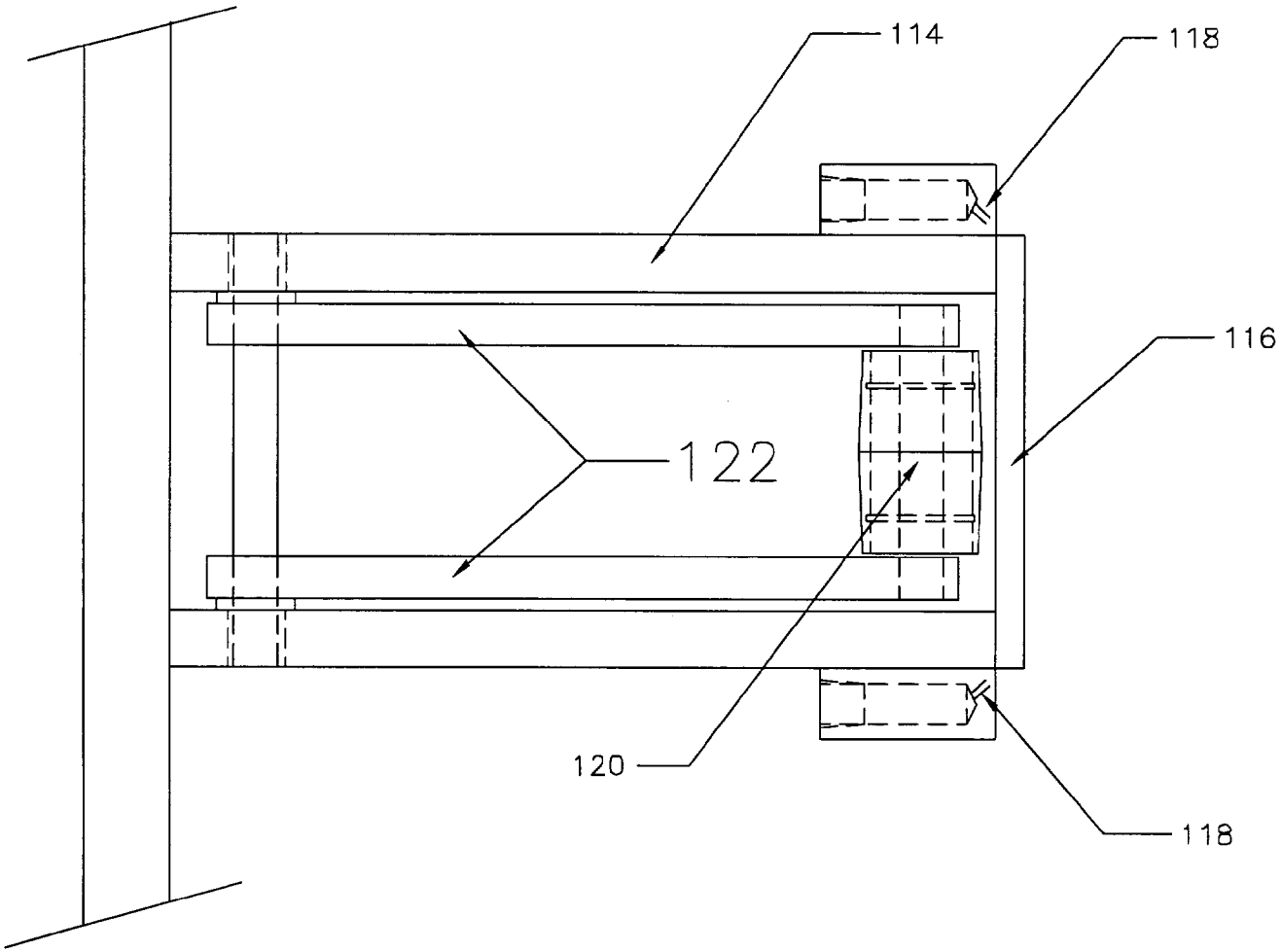
FIG. 6 shows the top view of the stripper gate and nip roller assembly for varying signature thicknesses.
Figure 7:
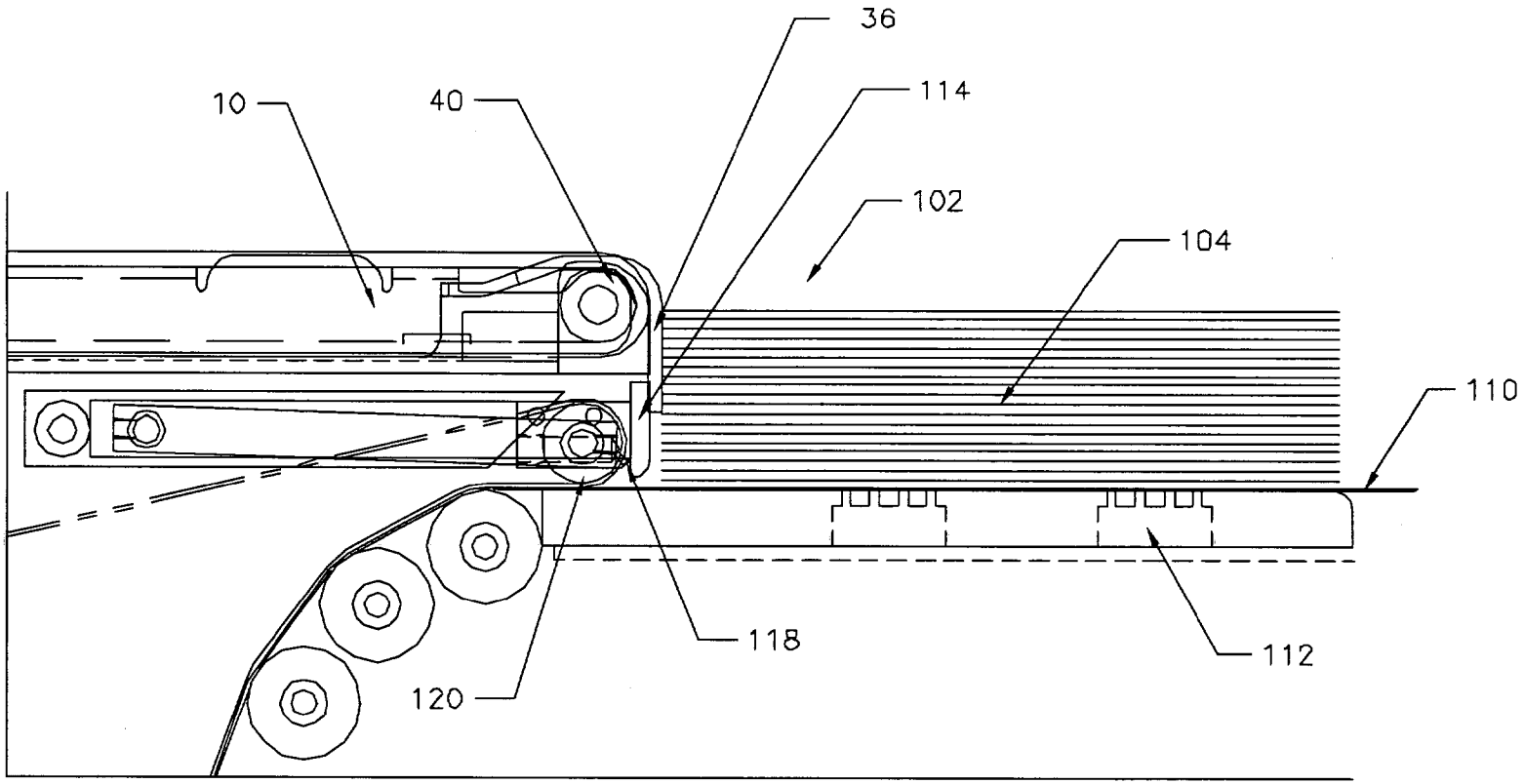
FIG. 7 shows the formation of a horizontally oriented stack of signatures ready for passage through the adjustable stripper gate and shows an adjustable stripper gate for varying signature thicknesses.
Figure 8:
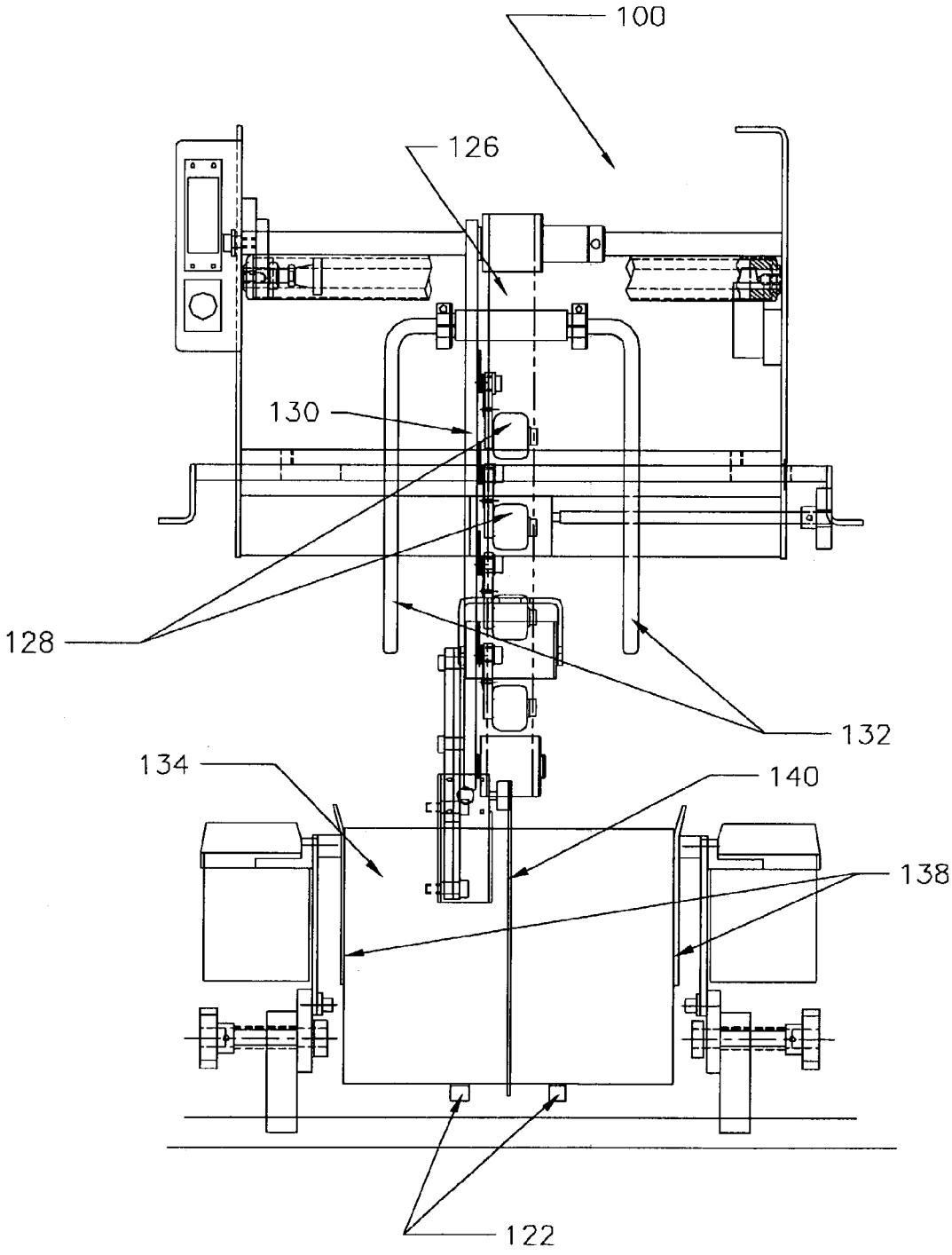
FIG. 8 shows a front elevation of the apparatus according to the invention.

FIGS. 5, 7 and 8 show an apparatus 100 for forming a generally vertically oriented stack of on-edge signatures from a horizontally oriented stack of signatures according to the invention. It has an accumulating hopper 102 for collecting a horizontally oriented stack of signatures 104. Hopper 102 receives a shingled stream of signatures 106 from a cooperating hopper loader 10. Hopper loaders 10 are well known in the art. As shingled stream 106 is supplied from hopper loader 10 to accumulating hopper 102 the signatures are formed into an aligned stack 104 by backstop 108, opposing paddles 36 of a jogger 34 and signature pushers, or end tappers 32. The stack 104 is formed on a vacuum conveyor. The size of the stack 104 may be controlled by sensing the height of the stack via photoelectric cell type controller 105 which controls the delivery of signatures from hopper loader 10. In one embodiment, the height of the stack in the accumulating hopper is limited to about 3 inches or less, preferably from about 1.5 to about 3 inches. The vacuum conveyor has a horizontally oriented portion comprising a vacuum conveyor belt 110 having a plurality of holes therethrough, and a vacuum source or plenum 112 which draws air through the vacuum conveyor belt holes and pulls a stream of lowermost signatures from the stack 104 and forms a downwardly directed shingled stream of the signatures against the belt 110 a downwardly extending portion of the vacuum conveyor. This downwardly directed shingled stream is formed by passing the lowermost signature under a stripper gate 114. As best seen in FIG. 6, stripper gate 114 comprises a bar 116 whose height is adjustable for varying signature thicknesses. On either side of bar 116 are downwardly directed air jets 118 which aid the separation of adjacent signatures. The separated signatures then pass under nip roller 120 which presses the lowermost signature against the vacuum belt and draws the lowermost signature away from the succeeding signature. In one embodiment, the position of the nip roller 120 is automatically adjustable or floatable by arms 121 to accommodate different signature stream thicknesses. After the lowermost signature passes under nip roller 120, it is directed toward a downwardly extending portion of the vacuum conveyor which leads signatures away from the accumulating hopper 102 toward a top surface of a receiving surface such as an indexing conveyor 122 via a guide section 124.

Guide section 124 is positioned parallel to the downwardly extending portion of the vacuum conveyor, and guide exerts a pressure normal to the top surface of the vacuum conveyor belt. Guide section 124 is shown to comprise a belt 126 which passes around a series of rollers 128 which are supported in a suitable frame 130.

The shingled stream of signatures is trapped between the vacuum conveyor belt and the belt 126 until the signatures are released from between the belts and deposited one by one into a substantially vertical stack onto receiving surface 122 which is preferably an indexing conveyor. In a preferred embodiment, the apparatus 100 also comprises a pair of bowing bars 132 behind rollers 128, which serve to slightly bend, or bow, the signatures as they are transported from the guide section onto receiving surface 122. This assists in assuring a neatly aligned vertical stack of signatures 134 on the receiving surface 122. In one embodiment, the combination of belt 126, rollers 128, frame 130, bowing bars 132 are adapted to pivot upwardly around point 136 to provide manual access to vertical stack 126 or receiving surface 122. This also allows an operator to optionally manually place a vertical stack 126 on receiving surface 122. In a one embodiment, attached to a lowermost part of the apparatus 100 are side vibrators 138 which jog the signatures as they drop onto the indexing surface 122, as well as a limit switch 140 to control the size of growing stack 134 by limiting the number of signatures delivered to the receiving surface. In use, signatures from stack 126 are removed one by one by a suitable device 142 such as bindery equipment for individually removing a stream of signatures on edge from the top surface of the receiving surface 122.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. An apparatus for forming a generally vertically oriented stack of on-edge signatures from a horizontally oriented stack of signatures which comprises:

an accumulating hopper for collecting a horizontally oriented stack of signatures;

a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, said guide comprising a guide belt which passes around a plurality of pressure rollers mounted in a frame, said pressure rollers being mounted in the frame parallel to the downwardly extending portion of the conveyor belt, which guide and series of rollers exert a pressure normal to a top surface of the conveyor belt; a pair of bowing bars which bend the signatures as they are transported from the guide onto the receiving surface; the conveyor belt and the guide being positioned to retain a shingled stream of signatures therebetween and being adapted for depositing an edge of each signature of the stream of signatures onto a top surface of a receiving surface.

2. The apparatus of claim 1 further comprising a receiving surface for receiving a deposited stream of on edge signatures which signatures are received on the receiving surface from a position between the conveyor belt and the guide.

3. The apparatus of claim 2 wherein the receiving surface comprises an indexing conveyor.

4. The apparatus of claim 1 further comprising a device for supplying signatures into the accumulating hopper.

5. The apparatus of claim 1 further comprising a device for supplying a stream of signatures into the accumulating hopper.

6. The apparatus of claim 1 wherein the guide is pivotable away from the conveyor belt.

7. The apparatus of claim 1 wherein the guide belt and the downwardly extending portion of the conveyor belt together form a nip therebetween for retaining a shingled stream of signatures against the conveyor belt.

8. The apparatus of claim 1 further comprising a signature gate for regulating the stream of lowermost signatures drawn from the accumulating hopper onto the conveyor belt.

9. The apparatus of claim 8 wherein the signature gate comprises a height adjustable bar positioned over the vacuum conveyor, a nip roller attached to the height adjustable bar for pressing a lowermost signature against the vacuum conveyor, and a pair of air jets attached to the height adjustable bar, one air jet on either side of the nip roller, which air jets are positioned to direct a flow of air for separating adjacent signatures.

10. The apparatus of claim 9 wherein the nip roller is mounted for adjustable positioning responsive to a thickness of a flow of signatures.

11. The apparatus of claim 1 further comprising a signature gate for regulating the stream of lowermost signatures drawn from the accumulating hopper onto the conveyor belt, which signature gate is positioned between the accumulating hopper and the conveyor belt.

12. The apparatus of claim 1 wherein the accumulating hopper comprises a laterally positioned jogger, a forward end stop and a rearwardly positioned end tapper.

13. The apparatus of claim 1 further comprising a controller for regulating a flow of signatures into the accumulating hopper.

14. The apparatus of claim 1 further comprising an aligner positioned adjacent to the receiving surface for aligning signatures as they are deposited onto a top surface of a receiving surface.

15. The apparatus of claim 14 wherein the aligner comprises at least one jogger.

16. The apparatus of claim 14 wherein the aligner comprises at least one vibrating jogger.

17. The apparatus of claim 14 wherein the aligner comprises at least one signature patter.

18. The apparatus of claim 14 wherein the aligner comprises a pair of signature patters mounted to pat opposing ends of a signature.

19. The apparatus of claim 1 further comprising a sensor for sensing the number of signatures on a receiving surface.

20. The apparatus of claim 19 further comprising a controller for controlling the rate of depositing signatures onto the receiving surface responsive to a signal from the sensor.

21. The apparatus of claim 20 wherein the controller continuously adjusts the rate of depositing signatures onto the receiving surface responsive to continuous signals from the sensor.

22. The apparatus of claim 21 wherein the controller continuously adjusts the rate of depositing signatures onto the receiving surface to maintain about a constant number of signatures on the receiving surface.

23. The apparatus of claim 20 wherein the controller comprises a programmable logic controller.

24. A method for forming a generally vertically oriented stack of on-edge signatures from a horizontally oriented stack of signatures which comprises:

I. providing an apparatus for forming a generally vertically oriented stack of on-edge signatures from a horizontally oriented stack of signatures which comprises: an accumulating hopper for collecting a horizontally oriented stack of signatures;

a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, said guide comprising a guide belt which passes around a plurality of pressure rollers mounted in a frame, said pressure rollers being mounted in the frame parallel to the downwardly extending portion of the conveyor belt, which guide and series of rollers exert a pressure normal to a top surface of the conveyor belt; a pair of bowing bars which bend the signatures as they are transported from the guide onto the receiving surface; the conveyor belt and the guide being positioned to retain a shingled stream of signatures therebetween and being adapted for depositing an edge of each signature of the stream of signatures onto a top surface of a receiving surface;

II. collecting a horizontally oriented stack of signatures in the accumulating hopper;

III. forming a shingled stream of said signatures against the conveyor belt by pulling a stream of lowermost signatures from the horizontally oriented stack of signatures in the accumulating hopper by the vacuum conveyor;

IV. leading the shingled stream of signatures away from the accumulating hopper and from the horizontally oriented vacuum source to the downwardly extending portion of the conveyor belt toward the top surface of a receiving surface while pressing the shingled stream of signatures between the guide and the conveyor belt, and depositing an edge of each signature of the stream of signatures onto a top surface of the receiving surface.

25. The method of claim 24 wherein the collecting of the horizontally oriented stack of signatures in the accumulating hopper is such that the height of the stack in the accumulating hopper is maintained at about 3 inches or less.

26. The method of claim 24 wherein each signature comprises a folded edge, and the shingled stream of signatures leads away from the accumulating hopper by the folded edge of each signature.

27. A machine for forming a generally vertically oriented stack of on-edge signatures which comprises:

I. an apparatus for forming a generally vertically oriented stack of on-edge signatures from a horizontally oriented stack of signatures which comprises:

an accumulating hopper for collecting a horizontally oriented stack of signatures;

a vacuum conveyor comprising a horizontally oriented vacuum source positioned at a lowermost level of the accumulating hopper and a conveyor belt having a plurality of holes therethrough, the conveyor belt having a horizontal portion which is in juxtaposition with the horizontally oriented vacuum source such that the vacuum source draws air through the conveyor belt holes for pulling a stream of lowermost signatures from a horizontally oriented stack of signatures from the accumulating hopper and forming a shingled stream of signatures against the conveyor belt; the horizontal portion of the conveyor belt leading to a downwardly extending portion of the conveyor belt which downwardly extending portion leads away from the vacuum source and the accumulating hopper toward a top surface of a receiving surface; a guide adjacent and parallel to the downwardly extending portion of the conveyor belt, said guide comprising a guide belt which passes around a plurality of pressure rollers mounted in a frame, said pressure rollers being mounted in the frame parallel to the downwardly extending portion of the conveyor belt which guide and series of rollers exert a pressure normal to a top surface of the conveyor belt; a pair of bowing bars which bend the signatures as they are transported from the guide onto the receiving surface; the conveyor belt and the guide being positioned to retain a shingled stream of signatures therebetween and being adapted for depositing an edge of each signature of the stream of signatures onto a top surface of a receiving surface, and II. a hopper-loader which deposits a stream of signatures into the accumulating hopper.

28. The machine of claim 27 wherein the hopper loader is attached to the apparatus at a position adjacent to the accumulating hopper.

29. The machine of claim 27 wherein the hopper loader comprises a) a chassis;

b) a first continuous, downwardly inclined planar conveyor mounted on the chassis; said first conveyor being capable of moving a parallelepiped shaped stack of vertically aligned signatures to a second conveyor and depositing a separated, shingled stream of the signatures onto the second conveyor; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

* * * * *